US005284396A

United States Patent [19]

Masumura et al.

[11] Patent Number: 5,284,396

[45] Date of Patent: Feb. 8, 1994

[54] RIBBON FEEDER FOR A PRINTER HAVING A TENSION MECHANISM

[75] Inventors: Yosinobu Masumura; Takayasu Hongo; Setsuo Sasabe, all of Amagasaki, Japan

[73] Assignee: Kanzaki Paper Mfg. Co., Ltd., Tokyo, Japan

[21] Appl. No.: 918,617

[22] Filed: Jul. 27, 1992

[30] Foreign Application Priority Data

Jul. 29, 1991 [JP] Japan ..... 3-212835

[51] Int. Cl.[5] ..... B41J 33/14

[52] U.S. Cl. ..... 400/234; 400/218; 226/195; 242/147 R

[58] Field of Search ..... 400/230, 234, 218, 621, 400/208, 120, 222; 226/195; 242/147 R, 155 R, 156.1

[56] References Cited

U.S. PATENT DOCUMENTS 3,665,855 5/1972 Nikoloff ..... 400/230

FOREIGN PATENT DOCUMENTS 0156786 9/1984 Japan ..... 400/234

0124279 7/1985 Japan ..... 400/234

0125875 6/1986 Japan ..... 400/234

0197267 9/1986 Japan ..... 400/234

0283980 11/1988 Japan ..... 400/234

0297085 11/1988 Japan ..... 400/234

OTHER PUBLICATIONS

IBM Technical Disclosure Bulletin, vol. 18, No. 12, May 1976 "Servo Controlled Typewriter Ribbon Take-Up Device".

*Primary Examiner*—Edgar S. Burr

*Assistant Examiner*—Christopher A. Bennett

*Attorney, Agent, or Firm*—Cushman, Darby & Cushman

[57] ABSTRACT

An object of the present invention is to provide a ribbon feeder to prevent a ribbon from slackening when a sheet is back-fed in a thermal printer. When a ribbon is fed from a ribbon feed roller, resistance is imparted to the rotation of the ribbon feed roller by a first spring. Further, resilient force is stored in a second spring by tension produced when the ribbon is fed from the ribbon feed roller. The ribbon tends to slacken when the sheet is back-fed, such slackening ribbon is rewound by reversely rotating the ribbon feed roller by the stored resilient force.

2 Claims, 4 Drawing Sheets

RIBBON FEEDER FOR A PRINTER HAVING A TENSION MECHANISM

BACKGROUND OF THE INVENTION

The invention relates to a thermal printer having a ribbon feeder.

Thermal printers with a cutter generally forward-feed a sheet to the cutter position after printing and then back-feed the cut end of the sheet to the print start position. In this case, the sheet, being in contact with a ribbon is back-fed, so that the ribbon is made to be back-fed together with the sheet. When the ribbon is back-fed, the ribbon becomes slack. This may cause abnormal feeding of the ribbon for the next printing or wrinkling the ribbon, which may lead to undesired problems such as defective printing.

In order to overcome such problems, the following techniques have been conventionally employed. In a first technique, a platen roller is separated from a thermal head to thereby stop the ribbon and back-feed only the sheet. In a second technique, a ribbon feed roller is reversely rotated simultaneously with the back-feeding of the sheet to thereby return the ribbon in an direction opposite to the ribbon feed direction. However, such techniques also have problems, such as making the control system of the thermal printer complicated and increasing the size of the thermal printer.

SUMMARY OF THE INVENTION

The object of the invention is to provide a thermal printer with a ribbon feeder, which does not allow the ribbon to become slack when a sheet is back-fed, without complicating the control system of the thermal printer nor increasing the size of the thermal printer.

In a thermal printer, resilient force is charged in a spring or the like by tension produced when a ribbon is fed from a ribbon feed roller. When the tension of the ribbon is lost, the ribbon feed roller is reversely rotated utilizing the resilient force stored in the spring or the like, so that the ribbon can be rewound to the ribbon feed roller.

When the ribbon becomes slack during the back-feeding of the sheet, one method of eliminating the slackening of the ribbon is to wind the slack ribbon back to the ribbon feed roller. The invention attempts to employ this method automatically using a simple mechanical drive mechanism involving no motor or the like. When the sheet is forward-fed, the ribbon is likewise forward-fed together with the sheet. The tension produced by pulling the ribbon at this instance is utilized to store resilient force in a storage section of the ribbon feed roller. When the tension derived from pulling the ribbon is lost, the ribbon feed roller is reversely rotated by the resilient force stored in the simple drive mechanism provided in the ribbon feed roller, so that the ribbon feed roller can be rotated reversely to thereby wind the slack ribbon back to the ribbon feed roller. This is the concept of the invention.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DETAILED DESCRIPTION OF THE PREFERRED EMBODIMENTS

1. First Embodiment

Figure 1:
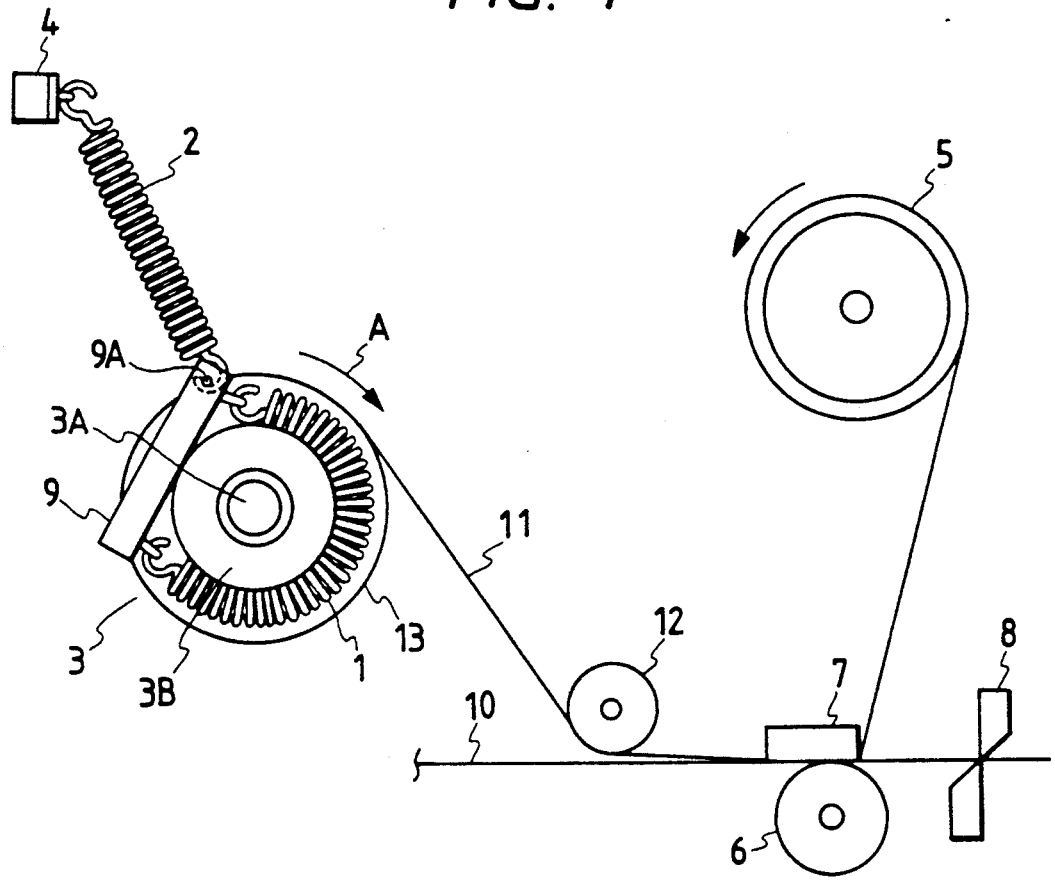
FIG. 1 is a side view showing a thermal printer in a state prior to printing, which printer is a first embodiment of the invention.
Figure 2:
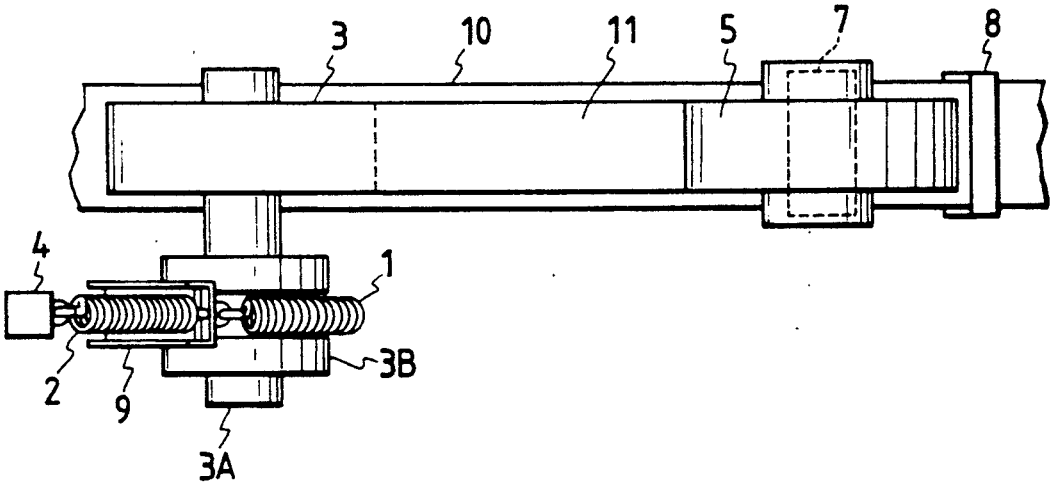
FIG. 2 is a top view of the thermal printer shown in FIG. 1.

FIG. 1 is a side view showing a thermal printer, which is a first embodiment of the invention, in a state prior to printing, and FIG. 2 is a top view thereof. In order to simplify the description of the arrangement of device of the present invention, an idler roller 12 is omitted from FIG. 2.

In FIGS. 1 and 2, a rolled ribbon 13 on a paper spool is mounted on a ribbon feed roller 3 so as to be integral with the ribbon feed roller 3. When printing begins, a sheet 10 is forward-fed to the right as viewed in FIGS. 1 and 2 by rotary force of a platen roller 6, with the sheet 10 overlapping a ribbon 11. The sheet 10 passes through the idler roller 12, between the platen roller 6 and a thermal head 7, and thorough a cutter 8. The ribbon 11 is rewound on a rewind roller 5 after passing through the thermal head 7. A collar 3B is secured to an end portion of a shaft 3A. The collar 3B is formed of a wear resistant resin, e.g., Duracon ® (manufactured by Poly Plastics Co., Ltd.), which is a kind of acetal copolymer. The collar 3B rotates integrally with the shaft 3A and the ribbon feed roller 3. The outer periphery of the collar 3B is fastened with a predetermined amount of force by a first spring 1 and a fastener 9. At this time, the force of the first spring 1 fastening the outer periphery of the collar 3B is adjustable by replacing the first spring 1. While the ribbon feed roller 3 and the shaft 3A which are formed integrally with the collar 3B are rotating, the first spring 1 is sliding over the outer periphery of the collar 3B, and dynamic frictional force is being produced by the force of the first spring 1 fastening the outer periphery of the collar 3B. This dynamic frictional force is maintained constant at all times since the force of the first spring 1 fastening the outer periphery of the collar 3B is constant. The collar 3B is made of a wear resistant resin such as described above lest this dynamic frictional force change over time due to wear of the collar 3B.

A shaft 9A is attached to an end of the fastener 9. This shaft 9A serves as a member for hooking an end of a second spring 2. The other end of the second spring 2 is hooked by a base 4 mounted on a frame.

The operation of each component during printing will be described next.

The ribbon 11 is advanced during printing by rotating the rewind roller 5. The feeding of the ribbon 11 causes the ribbon feed roller 3 to rotate in the ribbon feed direction. Feeding ribbon 11 also causes the rotation of the shaft 3A and the collar 3B integrated with the ribbon feed roller 3. During this rotation, at the start of printing, the first spring 1 and the fastener 9 rotate integrally together with the collar 3B in a direction indicated by an arrow A. Therefore, the second spring 2 is to be pulled by the shaft 9A. When the second spring 2 is expanded to a certain degree, the tension of the second spring 2 becomes larger than the static frictional force between the first spring 1 and the collar 3B. Further tension from the ribbon 11 causes the first spring 1 to start sliding relative to the collar 3B. That is, dynamic frictional force determined by the force of the first spring 1 fastening the outer periphery of the collar 3B acts upon the collar 3B. More specifically, a certain amount of resistance is imparted to the rotation of the ribbon feed roller 3.

Figure 3:
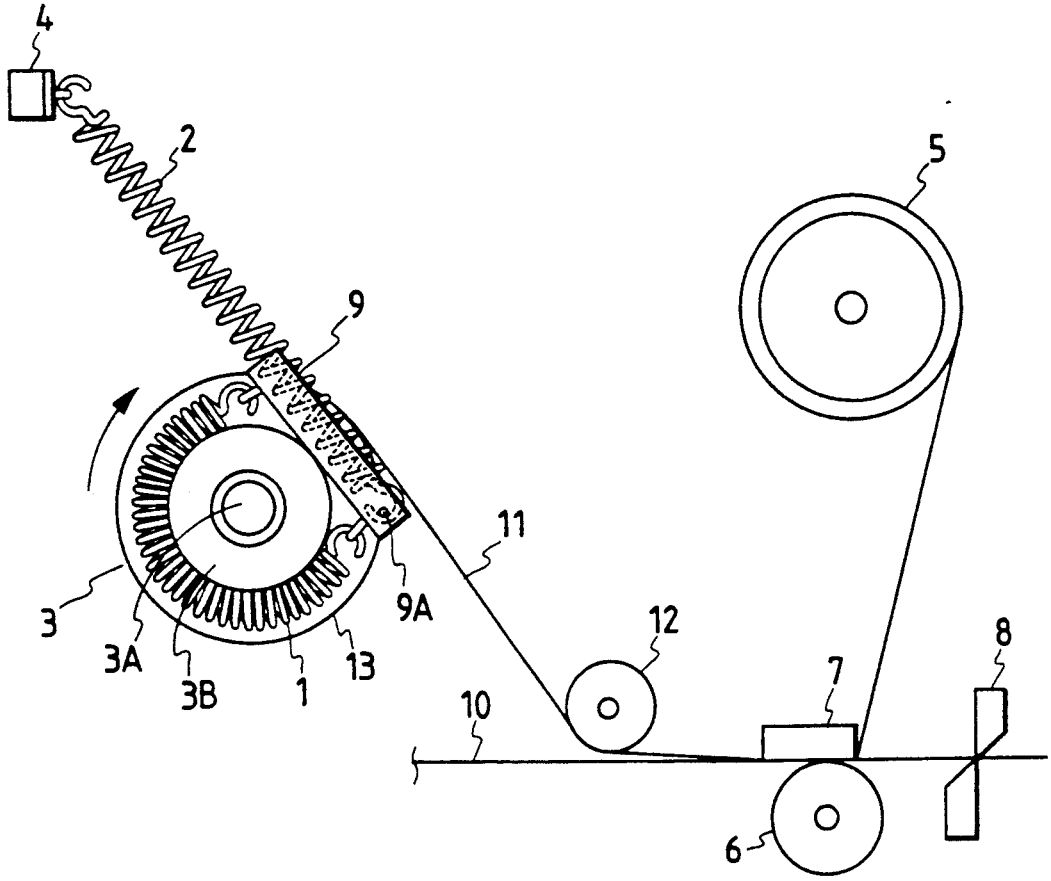
FIG. 3 is a side view of the thermal printer shown in FIG. 1 in a state in which resistance is imparted to the rotation of a ribbon feed roller 3.

FIG. 3 shows this state. In this state, the ribbon 11 is being fed while the certain amount of resistance derived from the dynamic frictional force between the first spring 1 and the collar 3B is being received by the ribbon feed roller 3 which causes the second spring 2 to expand. That is, as shown in FIG. 3, if an appropriate tension of the second spring 2 is selected, the tension of the second spring 2 becomes equal to the dynamic frictional force between the first spring 1 and the collar 3B when the second spring 2 and the ribbon 11 are aligned as in FIG. 4. More specifically, the second spring 2 is expanded in this state, and maintains some resilient force therein. As is understood from FIG. 2, part of the second spring 2 that is being pulled lies within the open side of the fastener 9. Additionally, since the second spring 2 and the ribbon 11 are on the straight line, all the tension of the second spring 2 acts directly opposed to the direction of tension of the ribbon 11, and there is no likelihood that the tension of the second spring 2 will undesirably affect the dynamic frictional force acting between the first spring 1 and the collar 3B. Further, since the second spring 2 expands in a straight line, the entire spring expands uniformly, which means that the fastener 9 is under a constant tension at all times.

If the dynamic frictional force between the first spring 1 and the collar 3B is large, the second spring 2 is expanded to a larger degree than as shown in FIG. 3. At this point, the second spring is no longer straight and there is a difference in expansion between the portion of the second spring 2 within the fastener 9 and the portion not therein contained. That is, the second spring 2 does not expand uniformly. This difference may disturb the rotation of the ribbon feed roller 3 at the time of feeding the ribbon 11. Therefore, as previously described, it is desirable to select the tension of the second spring 2 so that the second spring 2 and the ribbon 11 are exactly on the straight line.

The behavior of the invention at the time the printing ceases will be described next.

(1) Ending the Printing

The feeding of the sheet 10 and the ribbon 11 is stopped by stopping the rotation of the platen roller 6. At this point, the rewind roller 5 is also stopped but is put in a hold position so that the ribbon 11 does not rotate reversely by the resilient force stored in the second spring 2. Therefore, the second spring 2 remains in the expanded state shown in FIG. 3.

(2) Forward-Feeding the Sheet For Cutting

To cut the continuous sheet 10, a portion of the sheet 10 is forward-fed by a predetermined length. Simultaneously, the sheet 10 and the ribbon 11 are similarly fed as in the printing. Therefore, the second spring 2 remains in the expanded state shown in FIG. 3.

(3) Stopping the Forward-Feeding and Cutting the Sheet

The same state as in (1) "Ending the printing" is maintained. The sheet 10 is cut in this state. Therefore, the second spring 2 keeps the pulled state shown in FIG. 3.

(4) Back-feeding the Sheet (Reverse Feeding)

The sheet 10 is back-fed (reversely fed) by a distance equal to the distance forward-fed for sheet cuttings by a reversed rotation of the platen roller 6. The fastener 9 and the first spring 1 are pulled as the second spring 2 contracts to its original length. As a result, the ribbon feed roller 3 is rotated in the direction opposite to the direction indicated by the arrow A shown in FIG. 1, which then causes the ribbon 11 to be pulled in the back-feed direction. At this point, since the rewind roller 5 is left idle so as to be freely rotatable, the ribbon 11 is to be back-fed together with the sheet 10 in an overlapped manner and rewound on the ribbon feed roller 3. At this point, the length by which the ribbon 11 is back-fed is set to a value equal to or longer than the length by which the sheet 10 is back-fed by selecting the position of the base 4 and the second spring 2 appropriately. Even if the second spring 2 is slightly expanded after the ribbon 11 has been fully back-fed, such force is useful as a force for preventing the ribbon 11 from becoming slack. Therefore, it is preferable to set the length for back-feeding the ribbon 11 to a value longer than the length for back-feeding the sheet 10. Since the ribbon 11 is back-fed automatically, the sheet 10 is back-fed without slackening the ribbon 11.

The operation of back-feeding the ribbon 11 as described above is completed within a short period of time. Once the back-feeding has been completed, the rewind roller 5 is swiftly returned to the above-mentioned hold state so that the ribbon 11 will become slack. It is in this hold state that next printing is started.

2. Second Embodiment

Figure 4:
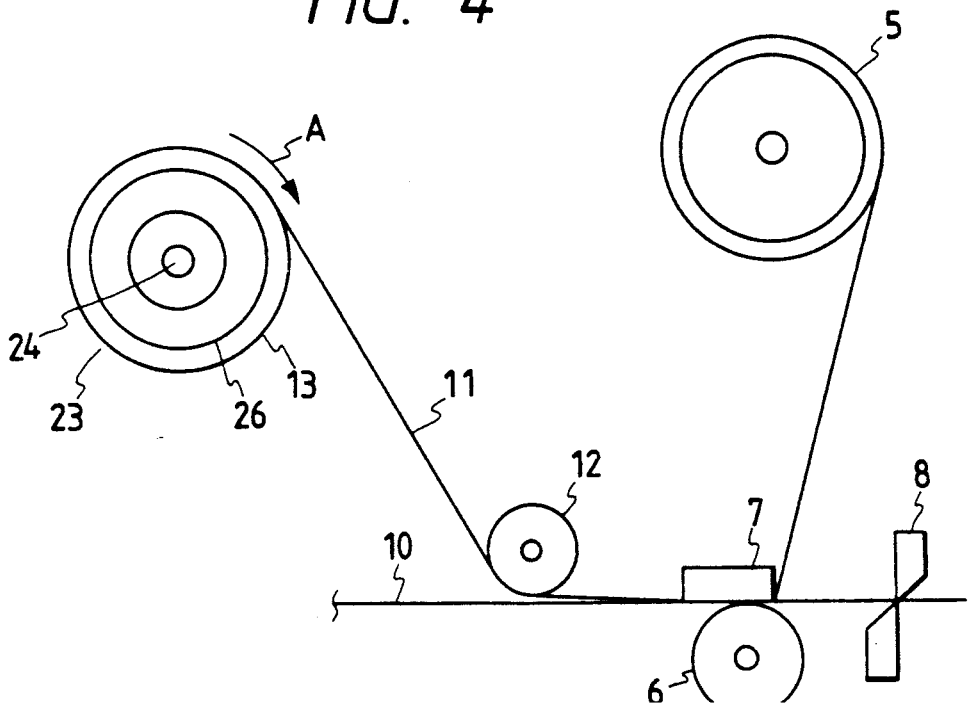
FIG. 4 is a side view showing a thermal printer, which is a second embodiment of the invention.
Figure 5:
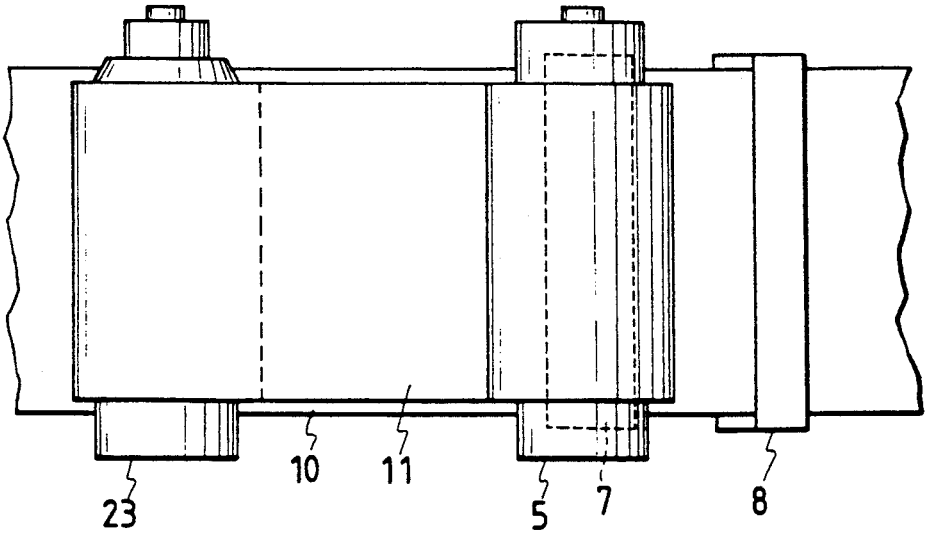
FIG. 5 is a top view of the thermal printer shown in FIG. 4.

FIG. 4 is a side view of a thermal printer, which is a second embodiment of the invention, and FIG. 5 is a top view thereof. In order to simplify the description of the arrangement of device of the present invention, the idler roller 12 is omitted from FIG. 5.

Corresponding parts and components to the first embodiment are shown by the same numerals and marks, and the description thereof made in the first embodiment similarly apply.

In FIGS. 4 and 5, a rolled ribbon 13 on a paper spool 26 is mounted on a ribbon feed roller 23 so as to be integral with the ribbon feed roller 23. Upon the start of printing, a sheet 10 is forward-fed to the right as viewed in FIGS. 1 and 2 by rotary force of a platen roller 6 with the sheet 10 overlapping a ribbon 11. The sheet 10 passes through an idler roller 12, between the platen roller 6 and a thermal head 7, and through a cutter 8. The ribbon 11 is rewound on a rewind roller 5 after passing through the thermal head 7. A shaft 24 of the ribbon feed roller 23 is fixed on a chassis (not shown). It is to this shaft 24 that the ribbon feed roller 23 is secured.

Figure 6:
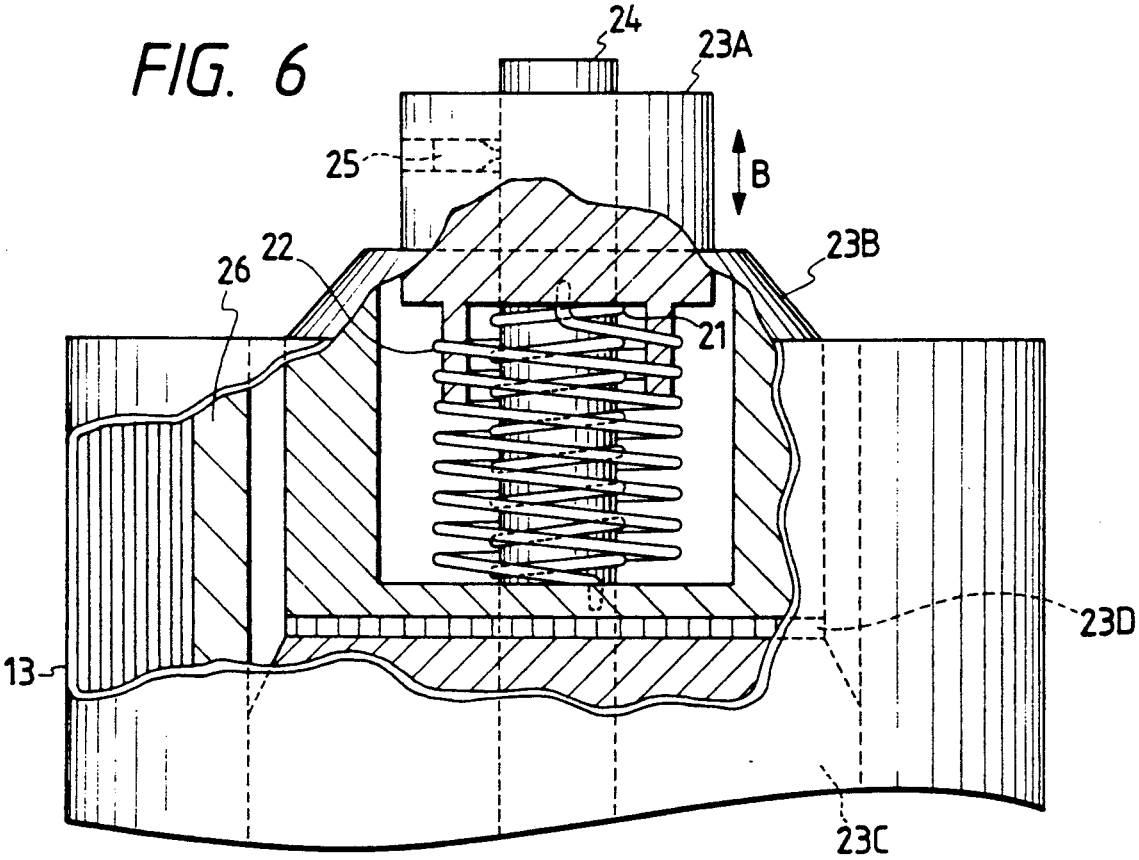
FIG. 6 is a partial sectional view showing a top end portion of a ribbon feed roller 23 with a rolled ribbon 13 mounted thereon.

A structure of the ribbon feed roller 23 is shown in FIG. 6. FIG. 6 is a partial sectional view showing an upper end portion of the ribbon feed roller 23 with the rolled ribbon 13 mounted. In FIG. 6, a cylindrical spring receiving member 23A is fixed to the shaft 24 by a screw 25 while inserted onto the shaft 24. The fixed position of the spring receiving member 23A can be changed in directions indicated by an arrow B in FIG. 6. A cylindrical spindle 23C is inserted onto the shaft 24 so as to be rotatable around the shaft 24 serving as a fixed shaft. The spindle 23C is fixed so as not to move along the axis of the shaft, i.e., in the direction indicated by the arrow B in FIG. 6. A spring cover 23B and a disc-like cork plate 23D are inserted between the spindle 23C and the spring receiving member 23A so as to be rotatable around the shaft 24. The spring cover 23B and the disk-like cork plate 23D are biased onto the spindle 23C with a brake spring 21 by a certain amount of force, the brake spring 21 serving as the first spring means. The biasing force of the brake spring 21 can be adjusted by changing the fixed position of the spring receiving member 23A as described previously.

Figure 7:
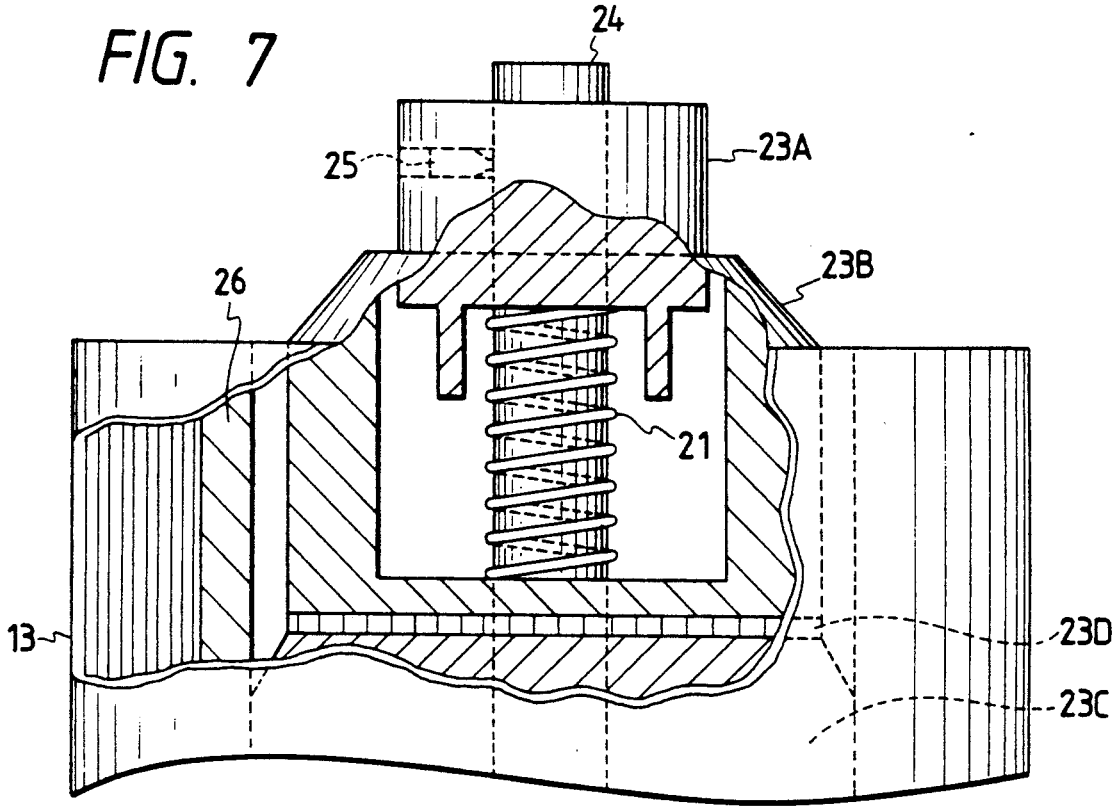
FIG. 7 is a diagram showing only a brake spring 21 out of two springs shown in FIG. 6.
Figure 8:
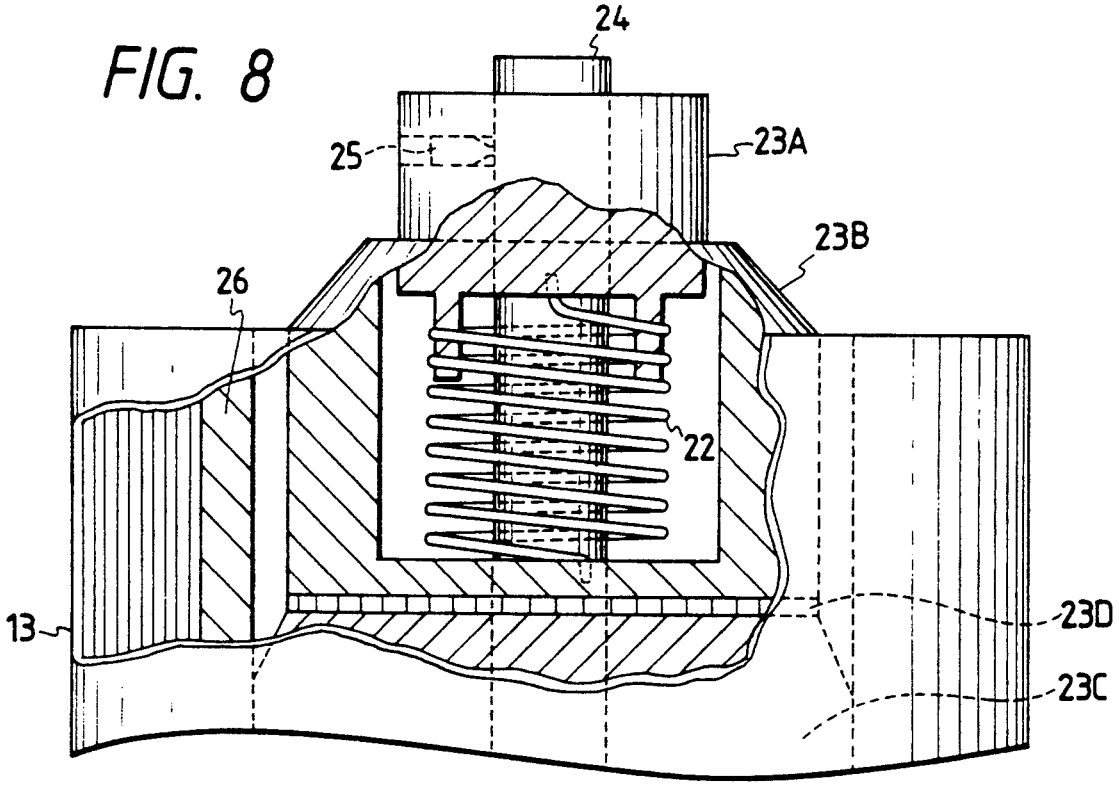
FIG. 8 is a diagram of an embodiment of the invention showing only a back-feed spring.

Further, the spring receiving member 23A is connected to the spring cover 23B through a back-feed spring 22 serving as the second spring means. These two springs, i.e., the brake spring 21 and the back-feed spring 22 are mounted coaxially. Since such a state is not well illustrated in FIG. 6, these springs are shown in FIGS. 7 and 8, respectively. FIG. 7 is a diagram showing only the brake spring 21 out of the two springs, whereas FIG. 8 is a diagram showing only the back-feed spring 22. As is understood from FIG. 8, one end 22A of the back-feed spring 22 is secured to the spring receiving member 23A and the other end 22B to the spring cover 23B.

The operation of each component during printing will be described next.

During printing the rewind roller 5 rotates to rewind the ribbon 11. The feeding of the ribbon 11 causes the ribbon feed roller 23 to rotate in the ribbon feed direction. The rotation of the ribbon feed roller 23 means that the spindle 23C rotates. When the spindle 23C initially rotates at the start of printing, the spring cover 23B and the disk-like cork plate 23D are biased onto the spindle 23C by the brake spring 21 with a certain amount of force. As a result, the spring cover 23B and the cork plate 23D rotate in a direction indicated by an arrow A integrally with the spindle 23C. Along with the rotation, the back-feed spring 22 is wound so as to store resilient force therein. When the back-feed spring 22 has been wound so that a certain amount of resilient force is stored, the resilient force of the back-feed spring 22 becomes larger than the static frictional force exerted by the brake spring 21 between the spring cover 23B and the spindle 23C. As a result, the spring cover 23B begins sliding relative to the spindle 23C that the spindle 23C has entered a post-initial rotation once the sliding occurs. During the post-initial rotation of the spindle 23C, the dynamic frictional force determined by the force of the brake spring 21 biasing the spindle 23C acts upon the spindle 23C. That is, the rotation of the spindle 23C is restricted by a certain amount of frictional resistance.

Under this state, the ribbon 11 is fed with the ribbon feed roller 23 receiving the certain amount of resistance derived from the dynamic frictional force between the spring cover 23B and the spindle 23C.

The behavior of the invention at the time the printing ceases will be described next.

(1) Ending the Printing

The feeding of the sheet 10 and the ribbon 11 is stopped by stopping the rotation of the platen roller 6. At this point, the rewind roller 5 is also stopped but is put in a hold position so that the ribbon 11 does not rotate reversely by the resilient force stored in the back-feed spring 22. Therefore, the back-feed spring 22 maintains the state in which the resilient force is stored.

(2) Forward-Feeding the Sheet For Cutting

To cut the continuous sheet 10, a portion of the sheet 10 is forward-fed by a predetermined length. Simultaneously, the sheet 10 and the ribbon 11 are similarly fed as in the printing. Therefore, the back-feed spring 22 maintains the state in which the resilient force is stored.

(3) Stopping the Forward-Feeding and Cutting the Sheet

The same state as in (1) "Ending the printing" is implemented. The sheet 10 is cut in this state. Therefore, the back-feed spring 22 maintains the state in which the resilient force is stored.

(4) Back-Feeding the Sheet (Reverse Feeding)

The sheet 10 is back-fed (reversely fed) by a distance equal to the distance forward-fed by reversely rotating the platen roller 6. The spring cover 23B and the spindle 23C are rotated integrally as the back-feed spring 22 contracts to its original state. Ribbon feed roller 23 is rotated in the direction opposite to the direction indicated by the arrow A shown in FIG. 4, which then causes the ribbon 11 to be pulled in the back-feed direction. At this point, since the rewind roller 5 is left idle so as to be freely rotatable, the ribbon 11 is back-fed together with the sheet 10 in an overlapped manner and rewound on the ribbon feed roller 23. At this point, being similar to the first embodiment, the length by which the ribbon 11 is to be back-fed is set to a value at least equal to or longer than the length by which the sheet 10 is back-fed by selecting the back-feed spring 22 appropriately. Thus, the ribbon 11 can be back-fed smoothly without becoming slack.

The operation of back-feeding the ribbon 11 as described above is completed within a short period of time. Once the back-feeding has been completed, the rewind roller 5 is swiftly returned to the above-mentioned hold state so that the ribbon 11 will not become slack. It is in this hold state that next printing is started.

Since the brake spring 21 and the back-feed spring 22 are contained within the spring cover 23B in the second embodiment, the mechanism is downsized compared with the first embodiment and thus less affected by external condition.

In the second embodiment the brake spring 21 may be omitted and the back-feed spring 22 may serve also as the brake spring 21 as shown in FIG. 8. In this case, resistance imparted to the ribbon feed roller 23 varies when the quantity of storaged resilient force of the back-feed spring 22 is changed. Therefore, to obtain high-quality printing it is necessary to select and design the springs and the mechanism so that the resilient force stored by the back-feed spring can be maintained constant to provide constant resistance to the ribbon feed roller 23 at all times.

While the examples of using the springs have been described in the above-mentioned embodiments, the same advantage can be obtained by using resilient bodies other than springs, e.g., rubber members.

According to the invention, resistance is given to the rotation of the ribbon feed roller by the first spring means when the ribbon feed roller feeds the ribbon. Further, the force for rotating the ribbon feed roller reversely by a predetermined amount in a direction opposite to the ribbon feed direction is stored in the second spring means as the resilient force. When the sheet is back-fed, the ribbon tends to become slack. However, the stored resilient force causes the ribbon feed roller to rotate reversely by a predetermined amount to rewind the slack ribbon. As a result, the ribbon is no longer subject to becoming slack. It is not necessary to install a motor for driving the ribbon feed roller reversely, which also requires motor control means, thus, the invention provides the solution while maintaining a simple construction.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications that fall within the true spirit and scope of the invention.

What is claimed is:

1. A ribbon feeder for a thermal printer, comprising:

a ribbon feed spool having a friction collar;

a biasing element applying a frictional force to the friction collar to resist rotation of the friction collar relative to the biasing element;

a first spring being arranged about the friction collar and having first and second ends being connected by the biasing element, the first spring providing a biasing force to the biasing element, such that relative rotation of the friction collar and the biasing element is resisted;

a second spring having first and second ends, the first end being fixed relative to the printer head, the second end being connected to the biasing element;

a ribbon pulling means for providing a pulling force on the ribbon for pulling the ribbon from the ribbon feed spool into the printer head, such that when tension is applied to the ribbon, the ribbon feed spool, friction collar, first spring and biasing element rotate about an axis of the ribbon feed spool until a tensile force in the second spring becomes equal to a frictional force between the biasing element and first spring and the friction collar.

2. A ribbon feeder according to claim 1, wherein the first and second springs are provided such that a longitudinal axis of the second spring is parallel to a direction of a tensile force in the ribbon when a tensile force in the second spring equals the frictional force between the first spring and the friction collar.

* * * * *